US005360592A

United States Patent [19]

Culling

[11] Patent Number: 5,360,592

[45] Date of Patent: Nov. 1, 1994

[54] ABRASION AND CORROSION RESISTANT ALLOYS

[75] Inventor: John H. Culling, St. Louis, Mo.

[73] Assignee: Carondelet Foundry Company, Pevely, Mo.

[21] Appl. No.: 96,507

[22] Filed: Jul. 22, 1993

[51] Int. Cl.[5] ..... C22C 30/00

[52] U.S. Cl. ..... 420/582; 420/586.1

[58] Field of Search ..... 420/582, 586.1

[56] References Cited

U.S. PATENT DOCUMENTS

| | | | |
|---|---|---|---|
| 4,063,934 | 12/1977 | Thuillier et al. | 420/582 |
| 4,080,198 | 3/1978 | Heyer et al. | 75/125 |
| 4,410,489 | 10/1983 | Asphahani | 420/453 |
| 4,536,232 | 8/1985 | Khandros et al. | 148/35 |

FOREIGN PATENT DOCUMENTS

| | | | |
|---|---|---|---|
| 47-31205 | 8/1972 | Japan | 420/49 |
| 59-38365 | 3/1984 | Japan | 420/49 |
| 0143050 | 8/1984 | Japan | 420/49 |
| 805187 | 12/1958 | United Kingdom | 420/582 |
| 1440362 | 6/1976 | United Kingdom | 420/49 |

OTHER PUBLICATIONS

Niu Hong-jun et al., Microstructure and Properties of a New Austenitic Heat-Resisting Steel Fe-Cr18.2-Ni6.-9-Mo2.5-C1.5, Heat-Resisting Materials Proceedings of the First International Conference, Fontana, Wisconsin, 23-26 Sep., 1991, pp. 269-274.

*Primary Examiner*—Deborah Yee

*Attorney, Agent, or Firm*—Senniger, Powers, Leavitt & Roedel

[57] ABSTRACT

A nickel-chromium-iron base alloy having improved corrosion and abrasion resistance which consists essentially of the following, by weight: nickel—28% to 45%, chromium—20% to 30%, molybdenum—1.5% to 6.2%, columbium—2.3% to 12%, carbon—0.3% to 1.5%, copper 0.8% to 4%, titanium—up to 1%, manganese—up to 1.5%, silicon—up to 1.5%, tantalum—up to 2%, tungsten—up to 2%, cobalt—up to 1%, nitrogen—up to 0.11%, iron—essentially balance.

11 Claims, 1 Drawing Sheet

ABRASION AND CORROSION RESISTANT ALLOYS

This invention relates to nickel-chromium-iron base alloys composed and structured so as to be superior to corrosion resistant iron, nickel and cobalt alloys for applications where both intergranular corrosion and abrasion of the metal may occur.

BACKGROUND OF THE INVENTION

A large portion of the problems in the chemical process industry leading to premature metal component degradation is the result of the combined effects of corrosion and wear. Often, items of equipment which suffer such degradation are the most critical components of the system, e.g., pumps, valve parts, agitators, wear shields, elbows, fan blades, filters and rolls. White cast irons, high carbon high chromium irons and high carbon cobalt-base alloys have exhibited excellent wear resistance but very limited corrosion resistance. Stainless steels and various low-carbon nickel-base and cobalt-base alloys have provided excellent corrosion resistance to many aggressive environments but very little resistance to abrasion.

In U.S. patent application Ser. No. 07/984,709, filed Dec. 3, 1992; now U.S. Pat. No. 5,246,661, I have disclosed alloys developed for severe abrasion and corrosion service such as encountered in wet process phosphoric acid reactors. Abrasion and corrosion degradation in such reactors is so severe that pumps made of prior art alloys typically need to be replaced every two to six months due to metal surface losses of the order of a half to three quarters of an inch. However, there are other corrosion applications in which longer service life may be expected due to somewhat less severe abrasion. In those instances surface metal loss rates may be low, but failure of the metallic parts may take place due to rapid intergranular attack along the matrix grain boundaries of alloys containing precipitated chromium carbides.

SUMMARY OF THE INVENTION

In response to those problems, alloys of the present invention provide excellent resistance to abrasion as well as to both surface and intergranular corrosion by oxidizing, neutral or reducing solutions.

Accordingly, among the several objects of the present invention may be noted the provision of alloys resistant to intergranular as well as general surface attack in corrosive streams, e.g., slurries or fluids, and from abrasion by hard particulate matter present in such streams; the provision of such alloys that may be easily formulated and manufactured by ordinary air melting and casting processes using readily available materials of moderate cost and low production process loss rates; the provision of such alloys that have sufficient ductility and toughness to avoid production cracking problems; and the provision of such alloys that are readily machinable by ordinary methods and tool materials.

Briefly, therefore, the present invention is directed to air-meltable, castable, machinable, weldable, hardenable alloys that are very resistant to wear and general or intergranular attack in highly corrosive and abrasive slurries. The instant alloys consist of, by weight, about 28% to about 45% nickel, about 20% to about 30% chromium, about 1.5% to about 6.2% molybdenum, about 0.8% to about 4% copper, about 2.3% to about 12% columbium (niobium), about 0.3% to about 1.5% carbon, up to about 2% tantalum, up to about 2% tungsten, up to about 1.5% silicon, up to about 1.5% manganese, up to about 1% titanium, small amounts of nitrogen that may be absorbed from the atmosphere during air melting, and the balance essentially iron and the usual impurities.

DESCRIPTION OF THE PREFERRED EMBODIMENT

Figure 1:
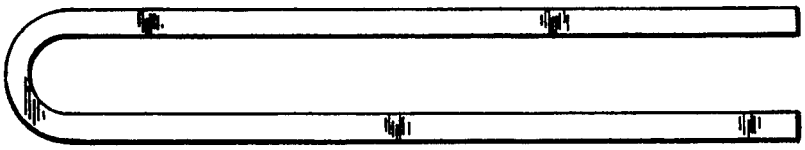
FIG. 1 is a top view of a U-bend casting of an alloy of the invention.

It is well known that carbon in iron-base or nickel-base alloys has a much higher affinity for columbium, tantalum and titanium than it has for chromium, molybdenum and tungsten. In the alloys of the present invention, even though they contain relatively very large amounts of carbon, virtually the entire content of that element is combined with columbium in the form of carbides, leaving the entire contents of chromium, molybdenum and possibly tungsten, substantially uncombined as metallic elements in the austenitic matrix phase. The columbium content of the alloys of the invention should preferably be present in amounts of between about 7.8 and about 11.3 times the carbon content by weight.

The nickel content of the alloys of the invention is so chosen that the alloy matrix is always single face austenite, i.e., face center cubic crystal structure. Cobalt occurs in some nickel ores and therefore present in the nickel produced from them. In amounts up to about 1%, cobalt is considered as nickel in alloys of the invention. The chromium levels of the alloys of the invention are preferably in the range of about 20% to about 25% for most applications but may be as high as 30% for such special applications as the handling of hot phosphoric or concentrated sulfuric acids.

The alloys of the invention contain a minimum of about 1.5% Mo for many corrosive applications and up to a maximum of about 6.2% Mo for the severest types of corrosion. In some substances, tungsten behaves chemically somewhat like molybdenum, and up to 2% W may sometimes be substituted for half of its weight of molybdenum, provided that molybdenum content itself never falls below 1.5%.

The copper content of the alloys of the invention should not exceed the stability limit of about 4% but is preferably above about 2.5% when chromium levels are as low as 20%. Copper may, however, be just as effective in many substances in amounts as low as about 0.8% if chromium exceeds about 23% or 24%. Small amounts of nitrogen on the order of about 0.04% to about 0.11% may be absorbed from the air during melting and will also combine with columbium in alloys of the invention but represent an insignificant factor.

Accordingly, the essential components of the alloys of the invention are:

| | |
|---|---|
| Nickel | 28% to 45% by weight |
| Chromium | 20% to 30% |
| Molybdenum | 1.5% to 6.2% |
| Copper | 0.8% to 4% |
| Columbium | 2.3% to 12% |
| Carbon | 0.3% to 1.5% |
| Iron | essentially balance |

Though not required, the alloys of the invention may further contain, by weight:

| | |
|---|---|
| Titanium | up to 1% |
| Silicon | up to 1.5% |
| Manganese | up to 1.5% |
| Tantalum | up to 2% |
| Tungsten | up to 2% |
| Cobalt | up to 1% |
| Nitrogen | up to 0.11% |

Titanium is a very reactive element and difficult to control without substantial and variable losses when added in large amounts to air melted alloys. Accordingly, while amounts of titanium of less than about 1% can be present in the alloys of the invention as an incidental inclusion from scraps, ferroalloys or other melting materials, it is not intentionally added for the purpose of stabilizing the carbon contents. Tantalum is much scarcer and more costly than columbium but does occur in some ore deposits along with its sister element. Up to 2% Ta is includable in alloys of the present invention on the basis of replacing half of its weight in columbium, but the latter element is principally relied upon for carbide stabilization.

For an excellent balance of mechanical properties, ease of production and abrasion plus corrosion resistance in a wide variety of applications the following ranges of elements have been found to be particularly desirable:

| | |
|---|---|
| Nickel | 28% to 38% by weight |
| Chromium | 22% to 25% |
| Molybdenum | 2% to 4% |
| Copper | 2% to 4% |

-continued

| | |
|---|---|
| Columbium | 5% to 8% |
| Carbon | 0.5 to 0.9% |
| Manganese | 0.3% to 0.9% |
| Silicon | 0.3% to 0.8% |
| Iron | essentially balance |

The following examples further illustrate the invention.

EXAMPLE 1

One hundred pound heats of several different alloys were prepared in accordance with the invention. Each of the heats was air-melted in a 100-pound high frequency induction furnace. The composition of the alloys of the invention (designated by letters) are set forth in Table I. One hundred pound heats of several other alloys (designated by numbers) were also prepared in the same manner. The composition of these alloys are also in Table I. It should be noted that alloy 232 was prepared in accordance with Khandros et al., U.S. Pat. No. 4,536,232, to conform to the published composition of the alloy as intended for wet process phosphoric acid reactor parts.

In addition, an 1800 pound production heat was prepared in a medium frequency induction furnace in accordance with U.S. patent application Ser. No. 07/984,709 except for carbon content. The heat was melted down at a 1.09% carbon level. Tensile test keel blocks and corrosion test blocks measuring 2.5 inches long by 1.25 inches wide by 0.4 inch thick were cast into dry sand molds. These test castings were identified as 997A. The carbon level of the remaining portion of the heat was then raised to 1.26% C and further test castings were poured and identified as 997B. Finally the carbon level of the remainder of the heat was raised to 1.51% and final test castings were poured and identified as 997C.

TABLE I

| | ALLOY COMPOSITION BY WEIGHT PERCENT | | | | | | | | |
|---|---|---|---|---|---|---|---|---|---|
| | Ni | Cr | Mo | Cb | C | Cu | Mn | Si | Other |
| INVENTIVE ALLOYS | | | | | | | | | |
| A | 36.04 | 22.02 | 3.15 | 7.27 | .65 | 3.00 | .63 | .82 | — |
| B | 35.16 | 22.11 | 3.08 | 10.91 | .98 | 2.88 | .54 | .56 | — |
| C | 28.82 | 21.31 | 2.14 | 5.01 | .51 | 2.72 | .74 | .33 | — |
| D | 28.31 | 22.04 | 2.29 | 4.82 | .71 | 2.57 | .44 | .53 | — |
| E | 44.16 | 25.15 | 4.16 | 6.63 | .84 | 3.28 | .55 | .41 | — |
| COMPARATIVE ALLOYS | | | | | | | | | |
| 997A | 13.60 | 26.51 | 2.23 | — | 1.09 | 1.21 | 1.04 | .89 | — |
| 997B | 13.59 | 26.64 | 2.24 | — | 1.26 | 1.21 | 1.05 | .88 | — |
| 997C | 13.57 | 26.80 | 2.26 | — | 1.51 | 1.21 | 1.06 | .87 | — |
| 1408 | 17.68 | 17.95 | 6.90 | — | .02 | 1.37 | 3.35 | .34 | .21N |
| 1422 | 28.21 | 23.31 | 2.52 | .56 | .02 | 2.30 | .72 | .47 | — |
| 1238 | 27.48 | 23.17 | 2.43 | 1.93 | .02 | 3.23 | .76 | .39 | — |
| 1458 | 8.03 | 25.21 | 4.55 | — | .02 | .82 | .71 | .54 | .15N, .31W |
| 232 | 2.03 | 27.88 | 2.11 | — | 1.61 | — | .67 | .91 | — |

The as cast mechanical properties of many of these alloys are set forth in Table II. Samples from a number of these heats were also aged for 80 hours at 1200° F. and rapidly cooled in air. The aged hardnesses of those affected are also set forth in Table II.

TABLE II

| MECHANICAL PROPERTIES AS CAST | | | | | |
|---|---|---|---|---|---|
| ALLOY DESIGNATION | TENSILE STRENGTH PSI | YIELD STRENGTH PSI | % ELONGATION | BHN | AGED BHN |
| A | 64,300 | 40,900 | 3.5 | 192 | 257 |
| B | 71,600 | 39,100 | 2 | 244 | 314 |
| C | 69,700 | 38,500 | 9 | 188 | 223 |
| D | 67,700 | 37,200 | 3 | 210 | 270 |
| E | 74,000 | 60,000 | 2.5 | 215 | 275 |
| 1408 | 80,200 | 45.800 | 20 | 170 | — |
| 1422 | 65,800 | 30,200 | 61 | 112 | — |
| 1238 | 61,000 | 21,000 | 20 | 143 | — |
| 1458 | 98,900 | 73,700 | 2 | 255 | — |
| 232 | — | — | — | 380 | — |
| 997A | 63,100 | 51,700 | 1.5 | 197 | 269 |
| 997B | 67,000 | 58,800 | 1.0 | 255 | 286 |
| 997C | 67,900 | 57,000 | .5 | 269 | 321 |

Comparison of the alloys of Table I with the data in Table II shows that alloys of the invention with carbon contents within the preferred range of 0.5% to 0.9% had elongations of 2.5% to 9% and aged hardnesses of 223 to 275 Brinell (BHN).

EXAMPLE 2

A test block of each of the inventive alloys, as well as one from each of a number of comparative alloys, was placed upon a bed of one-half-inch diameter glass marbles on the bottom of a 600 ml beaker containing 425 cc of 50% sulfuric acid solution by weight plus 48 grams of reagent grade copper sulfate and copper metal granules of about two millimeters diameter. The beaker contents were held at 60° C. for eight days with the test block in contact with the copper granules.

Each test block was then immersed in 70% nitric acid at room temperature for ten minutes to remove all traces of deposited copper and brushed with a stainless steel bristle brush to remove all loose particles and scale. Each block was weighed to the nearest thousandth of a gram before and after this test and the weight loss was recorded. The exposed blocks were then cut at approximately the mid-line of the 2.5 inch length. The exposed sections were polished, and the apparent intergranular penetration was measured under 50X magnification with a micrometer caliper. The grams weight loss and the apparent depth of intergranular attack are set forth in Table III.

TABLE III

| ALLOY DESIGNATION | WEIGHT LOSS | DEPTH OF PENETRATION, INCHES |
|---|---|---|
| A | 0.827 | None Observed |
| B | 0.957 | None Observed |
| C | 0.692 | None Observed |
| D | 0.835 | None Observed |
| E | 0.902 | None Observed |
| 232 | 21.012 | 0.076 |
| 997A | 6.912 | 0.025 |
| 997B | 5.677 | 0.021 |
| 997C | 4.961 | 0.018 |

Wet process phosphoric acid reactor pump equipment produced from alloy 232 is typically removed after two to four months due to surface wear but has failed from intergranular attack in applications involving less abrasion. The 997 alloy was designed as a replacement for alloy 232 and still suffered intergranular penetration on the order of about one third of the rate indicated for alloy 232. The test samples of the alloys of the invention showed considerably less attack in the extremely corrosive solution used in the test than the comparative alloys and no observable intergranular penetration.

EXAMPLE 3

A test block from each of the inventive alloys and one from each of several comparative alloys was placed in a one liter flask in such a manner that one end rested on a bed of one half inch diameter marbles and the other end rested against the side of the flask. In this manner virtually the entire surface of the block was exposed to a test solution of 600 cc of 25% nitric acid. The flask had a ground glass neck and was fitted with a water-cooled glass condenser. Each sample was exposed to the solution at a boil for 24 hours.

Each test block was then weighed to the nearest 1,000th of a gram before and after exposure. The measured weight loss was converted to a figure of average depth of penetration in mils per year, MPY, in accordance with the relationship:

$$MPY = 393.7 \frac{W_0 - W_f}{ATD}$$

where $W_O$=original weight of sample $W_f$=final weight of sample

A=area of sample in square centimeters

T=duration of the test in years

D=density of the alloy in grams per cubic centimeter

The results from these tests are set forth in Table IV.

TABLE IV

| WEIGHT LOSS IN BOILING 25% NITRIC ACID | |
|---|---|
| ALLOY DESIGNATION | LOSS RATE, MPY |
| A | 10.2 |
| B | 14.9 |
| C | 12.7 |
| D | 13.6 |
| E | 11.2 |
| 1408 | 26.7 |
| 1422 | 3.2 |
| 1238 | 4.7 |
| 1458 | 1.6 |

Boiling 25% nitric acid is a very strongly oxidizing substance. The loss rates for the alloys of the invention are approximately equal to those expected for stainless steels of the 18% Cr-8% Ni type with a carbon content of about 0.07% to 0.13%. Comparative alloy 1408 is a very high molybdenum content modified stainless steel developed for resistance to chloride solutions and had about twice the attack rate of the inventive alloys. Alloy 1422 is similar to the alloys of the invention but of low carbon content. The alloys of the invention had carbon contents of from 25 to 50 times that of alloy 1422 but attack rates in this solution of only about 3 to 5 times that of alloy 1422 and well within acceptable rates for typical chemical process equipment.

EXAMPLE 4

In the manner of Example 3, sample from the inventive alloys and a few comparative alloys were exposed to boiling 10% (weight) sulfuric acid for 24 hours, and the weight losses observed. The results of these tests are set forth in Table V.

TABLE V

| WEIGHT LOSS IN BOILING 10% SULFURIC ACID | |
|---|---|
| ALLOY DESIGNATION | LOSS RATE, MPY |
| A | 4.5 |
| B | 5.6 |
| C | 5.3 |
| D | 6.7 |
| E | 2.6 |
| 1408 | 36.5 |
| 1422 | 9.2 |
| 1238 | 31.8 |
| 1458 | 170.9 |

Boiling 10% sulfuric acid is a very strongly reducing substance, as is phosphoric acid. The loss rates for alloys of the invention are extremely low even as compared to alloys 1422 and 1238 developed specifically for handling hot sulfuric acid. Alloy 1458, which resisted the nitric acid very well, is rapidly attacked in this acid. Columbium in the matrix of an alloy has been found to be detrimental to the resistance of many alloys to sulfuric acid. Alloy 1238 is quite similar to alloy 1422, except that the former contains 1.95% Cb and had a rate loss of 31.8 MPY compared to 9.2 MPY for the latter. Thus, while high carbon contents are extremely detrimental to alloys in nitric acid, and high columbium contents are quite detrimental in sulfuric acid, these two elements eliminate the deleterious effects of either alone when present together in the relative proportions preferred in the present invention.

EXAMPLE 5

In the manner of Example 3, samples from the inventive alloys and a few comparative alloys were exposed to boiling 25 weight percent sulfuric acid for 24 hours and the weight losses observed. The results of these tests are set forth in Table VI. Also listed in this table is the published rate loss for alloy 20Cb3, the most widely employed alloy for handling hot sulfuric acid.

TABLE VI

| WEIGHT LOSS IN BOILING 25% SULFURIC ACID | |
|---|---|
| ALLOY DESIGNATION | LOSS RATE, MPY |
| A | 48.9 |
| B | 49.7 |
| C | 51.6 |
| D | 48.0 |
| E | 86.7 |
| 1422 | 99.4 |
| 1238 | 186.5 |
| 1458 | 360.6 |
| 20CB3 | 50 |

The deleterious effects of the uncombined columbium present in the low carbon content alloy 1238 and of the high molybdenum contents of alloy 1458 and inventive alloy E in this extremely aggressive test are evident. Even though high molybdenum content alloys are desirable in many circumstances it is evident that that is not the case in this situation.

EXAMPLE 6

Figure 2:
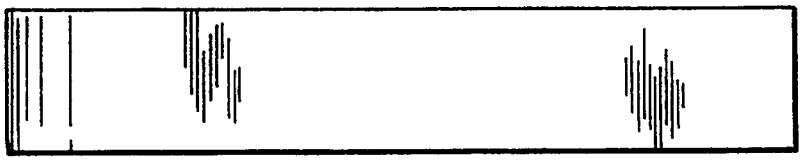
FIG. 2 is a front view of a U-bend casting of an alloy of the invention.
Figure 3:
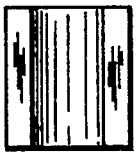
FIG. 3 is a right side view of a U-bend casting of an alloy of the invention.
Figure 4:
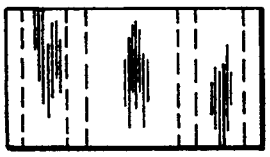
FIG. 4 is a top view of a wedge shaped casting of an alloy of the invention.
Figure 5:
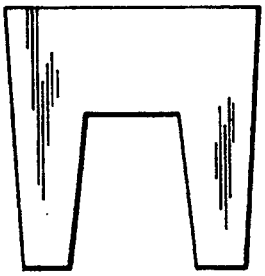
FIG. 5 is a front view of a wedge shaped casting of an alloy of the invention.
Figure 6:
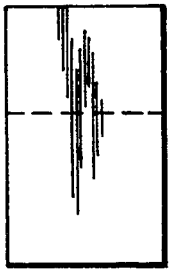
FIG. 6 is a bottom view of a wedge shaped casting of an alloy of the invention.
Figure 7:
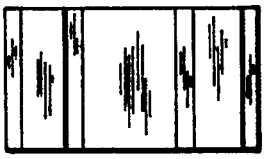
FIG. 7 is a side view of a wedge shaped casting of an alloy of the invention.

It is well known that many austenitic alloys are subject to stress corrosion cracking failure in acid chloride solution. While the present invention is directed to alloys resistant to integranular attack, they were also tested for their susceptibility to stress corrosion cracking failure in acid chloride solutions. Accordingly, castings were made of the alloys of the invention in the shapes depicted in FIGS. 1–7; four U-bend samples and four wedge shaped samples were selected for each alloy. Each U-bend was cut off between the pairs of cored holes so that the overall length of the shortened U-bend was $3\frac{1}{4}''$.

The legs of each U-bend were then spread open so that the inside distance between the shortened legs measured 0.6 inch. All samples were then heated to 1450° F. for four hours and then cooled to room temperature. The legs were then forced together in a vice for a sufficient distance so that the wedge shaped castings could be driven over the cut ends in the direction of the U. In this manner four samples from each inventive alloy were held in a stressed configuration.

Each of these samples was then immersed in 800 cc of boiling solution of tap water containing 25% sodium chloride and 0.5% hydrochloric acid (0.9pH) in a liter flask fitted with a cold reflux condenser and held at a boil for fourteen 24-hour periods, with the boiling solution being replaced every 24 hours.

U-bend and wedge samples were also cast from our regular production heats of alloys CF-3 and of CF-3M, which are the cast versions of 304L and 316L stainless steels. The samples were also cut, assembled and exposed in the manner of the inventive alloys above. When the boiling fluids were changed daily three of the CF-3 samples were found to have cracked in the curved portion of the U-bend sample at the end of three days, while the fourth sample was cracked by the fourth day. Three of the CF-3M samples were found cracked after six exposure periods, and the fourth after seven. These samples contained about 2.5% Mo, which is added to corrosion-resistant alloys to improve resistance to chloride.

None of the samples of the inventive alloys were cracked at the end of fourteen 24-hour boiling periods. It is believed that all stainless iron-base and nickel-base alloys can be made to crack eventually under severe enough conditions of acid chloride exposure, but the alloys of the invention demonstrate excellent resistance to this mode of failure, though they were primarily designed to resist abrasion plus general and intergranular corrosion.

Although specific examples of the present invention are provided herein, it is not intended that they are exhaustive or limiting of the invention. These illustrations and explanations are intended to acquaint others skilled in the art with the invention, its principles, and its practical application, so that they may adapt and apply the invention in its numerous forms, as may be best suited to the requirements of a particular use.

What the claimed is:

1. An alloy consisting essentially of:

| | |
|---|---|
| Nickel | 28% to 45% by weight |
| Chromium | 20% to 30% |
| Molybdenum | 1.5% to 6.2% |
| Columbium | 2.3% to 12% |
| Carbon | 0.3% to 1.5% |
| Copper | 0.8% to 4% |
| Titanium | up to 1% |
| Manganese | up to 1.5% |
| Silicon | up to 1.5% |
| Tantalum | up to 2% |
| Tungsten | up to 2% |
| Cobalt | up to 1% |

-continued

| | |
|---|---|
| Nitrogen | up to 0.11% |
| Iron | essentially balance. |

2. An alloy of claim 1 consisting essentially of:

| | |
|---|---|
| Nickel | 28% to 38% by weight |
| Chromium | 22% to 25% |
| Molybdenum | 2% to 4% |
| Columbium | 5% to 8% |
| Carbon | 0.5% to 0.9% |
| Copper | 2% to 4% |
| Manganese | 0.3% to 0.8% |
| Titanium | up to 1% |
| Silicon | 0.3% to 0.8% |
| Tungsten | up to 2% |
| Cobalt | up to 1% |
| Nitrogen | up to 0.11% |
| Iron | essentially balance. |

3. An alloy of claim 2 wherein:

| | |
|---|---|
| Nickel | 28% to 29% by weight |
| Chromium | 21% to 22% |
| Molybdenum | 2% to 2.5% |
| Columbium | 4.8% to 5% |
| Carbon | 0.5% to 0.7% |
| Copper | 2.5% to 3% |
| Manganese | 0.4% to 0.8% |
| Silicon | 0.3% to 0.5%. |

4. An alloy of claim 1 wherein:

| | |
|---|---|
| Nickel | 36.04% by weight |
| Chromium | 22.02% |
| Molybdenum | 3.15% |
| Columbium | 7.27% |
| Carbon | 0.65% |
| Copper | 3.00% |
| Manganese | 0.63% |
| Silicon | 0.82%. |

5. An alloy of claim 1 wherein:

| | |
|---|---|
| Nickel | 35.16% by weight |
| Chromium | 22.11% |
| Molybdenum | 3.08% |
| Columbium | 10.91% |
| Carbon | 0.98% |
| Copper | 2.88% |
| Manganese | 0.54% |
| Silicon | 0.56%. |

6. An alloy of claim 1 wherein:

| | |
|---|---|
| Nickel | 28.82% by weight |
| Chromium | 21.31% |
| Molybdenum | 2.14% |
| Columbium | 5.01% |
| Carbon | 0.51% |
| Copper | 2.72% |
| Manganese | 0.74% |
| Silicon | 0.33%. |

7. An alloy of claim 1 wherein:

| | |
|---|---|
| Nickel | 28.31% by weight |
| Chromium | 22.04% |
| Molybdenum | 2.29% |
| Columbium | 4.82% |
| Carbon | 0.71% |
| Copper | 2.57% |
| Manganese | 0.44% |
| Silicon | 0.53%. |

8. An alloy of claim 1 wherein:

| | |
|---|---|
| Nickel | 44.16% by weight |
| Chromium | 25.15% |
| Molybdenum | 4.16% |
| Columbium | 6.63% |
| Carbon | 0.84% |
| Copper | 3.28% |
| Manganese | 0.55% |
| Silicon | 0.41%. |

9. An alloy consisting essentially of:

| | |
|---|---|
| Nickel | 28% to 45% by weight |
| Chromium | 20% to 30% |
| Molybdenum | 1.5% to 6.2% |
| Columbium | 2.3% to 12% |
| Carbon | 0.3% to 1.5% |
| Copper | 0.8% to 4% |
| Titanium | up to 1% |
| Manganese | up to 1.5% |
| Silicon | up to 1.5% |
| Tantalum | up to 2% |
| Tungsten | up to 2% |
| Cobalt | up to 1% |
| Nitrogen | up to 0.11% |
| Iron | essentially balance |

said alloy having a columbium content by weight which is between 7.8 and 11.3 times the carbon content by weight.

10. An alloy of claim 9 consisting essentially of:

| | |
|---|---|
| Nickel | 28% to 38% by weight |
| Chromium | 22% to 25% |
| Molybdenum | 2% to 4% |
| Columbium | 5% to 8% |
| Carbon | 0.5% to 0.9% |
| Copper | 2% to 4% |
| Manganese | 0.3% to 0.9% |
| Titanium | up to 1% |
| Silicon | 0.3% to 0.8% |
| Tungsten | up to 2% |
| Cobalt | up to 1% |
| Nitrogen | up to 0.11% |
| Iron | essentially balance. |

11. An alloy of claim 10 wherein:

| | |
|---|---|
| Nickel | 28% to 29% by weight |
| Chromium | 21% to 22% |
| Molybdenum | 2% to 2.5% |
| Columbium | 4.8% to 5% |
| Carbon | 0.5% to 0.7% |
| Copper | 2.5% to 3% |
| Manganese | 0.4% to 0.8% |
| Silicon | 0.3% to 0.5%. |

* * * * *